United States Patent [19]

Giezen

[11] Patent Number: 4,474,655

[45] Date of Patent: Oct. 2, 1984

[54] METHOD FOR THE DETINNING OF PAINTED TINPLATE WASTE

[75] Inventor: Hendrik Giezen, Leeuwarden, Netherlands

[73] Assignee: Nederlandse Onttinnings-fabriek B.V., Leeuwarden, Netherlands

[21] Appl. No.: 534,560

[22] Filed: Sep. 22, 1983

[30] Foreign Application Priority Data

Sep. 30, 1982 [NL] Netherlands ..... 8203794

[51] Int. Cl.[3] ..... C25C 1/14; C25F 5/00

[52] U.S. Cl. ..... 204/121; 204/146

[58] Field of Search ..... 204/146, 121

[56] References Cited

U.S. PATENT DOCUMENTS

| | | | |
|---|---|---|---|
| 1,511,590 | 10/1924 | Buttfield | 204/121 |
| 2,229,073 | 1/1941 | Gregory | 204/146 |
| 3,198,720 | 8/1965 | Knippers | 204/146 |

*Primary Examiner*—Thomas Tufariello

[57] ABSTRACT

Detinning of tinplate waste is carried out by electrolysis with the waste acting as an anode immersed in an electrolytic bath containing NaOH. When detinning painted tinplate waste, in order to reduce the effect of the paint on the detinning process, the painted tinplate waste is first compressed, then immersed in an NaOH solution for sufficient time to allow the NaOH to soften the paint, and then the electrolysis is carried out in the same or a different solutin, to remove the tin beneath the paint. Preferably the softened paint is not removed from the tinplate.

15 Claims, No Drawings

METHOD FOR THE DETINNING OF PAINTED TINPLATE WASTE

BACKGROUND OF THE INVENTION

1. Field of the Invention

The invention relates to a method for the detinning of painted tinned sheet waste (tinplate waste) in which the waste is arranged in a bath containing NaOH and subjected to an electrolytic treatment as an anode. By "paint" is included any adherent protective coating of a similar nature to paint.

2. Description of the Prior Art

In the processing of tinplate, 10 to 20% cutting waste is produced. This waste is not processable as scrap for the steel industry because of the high tin content. The same applies to tinplate which is recovered by separation of domestic refuse, or in the separated collection of domestic refuse. Steel scrap of a high quality can however be produced by detinning these waste materials, whilst the recovered tin has a high commercial value.

A conventional method of detinning tinplate waste consists in tipping the material to be detinned loosely into a basket which is then placed in an electrolytic bath. Steel plates are suspended next to the basket, and the basket and these steel plates are connected to a voltage source as electrodes for an electrolytic process, in which the basket (and thus the tinplate itself) and the bath walls serve as the anode, and the steel plates as the cathode, causing the tin from the tinplate waste to be dissolved and deposited on the steel plates. From time to time this deposited tin is removed from the cathodes. After detinning, the detinned material is washed with clean water, and pressed into steel scrap bundles. When processing clean, unpainted tinplate waste it is possible to detin baskets with a content of 80 to 100 kg tinplate in approximately 2½hours to obtain a residual tin content of less than 0.2% Sn.

In order to render tinplate suitable for many applications, one or more coats of paint are nowadays very often applied to it. These coats of paint provide additional protection, but make detinning more difficult because the layer of tin is screened off from the electrolytic bath.

Various measures have been proposed for reducing the effect of the paint on the detinning process. Thus it has been proposed to give the painted tinplate waste a heat pretreatment, in which the paint is burnt off. It has also been proposed intensively to damage the coat of paint mechanically so that the electrolyte gains access to the underlying tin layer. Both methods suffer from the most serious disadvantage that they give rise to considerable and undesirable contamination of the electrolytic bath as a result respectively of ash residues deriving from the paint, and of flakes of paint that have come loose in the mechanical pretreatment.

It is conventional to wash the detinned waste with water before processing it further as scrap. In the case of highly contaminated detinning baths, conventional washing leads to a relatively high residual tin content in the scrap, which is undesirable. On the other hand, if additional washing is carried out, then more tin may be lost in the washing water.

It has also been proposed to attack the coat of paint chemically first, for example by means of polyethylene glycol ether, or by means of methyl alcohol. One drawback to this method consists in that the chemicals used either fail to attack all the known paints used, or are so toxic that the entire process must be carried out in closed vessels, thereby increasing costs. In most cases this process must also be carried out at a high temperature.

More specifically, FR-A No. 1 496 440 describes the use of polyethylene glycol ethers to remove paint prior to, for example, electrolytic detinning. Paint removal is apparently aimed at, and it is clear that the glycolic ethers achieve this. FR-A No. 1 000 856 also proposes the use of soap solutions containing sodium hydroxide to achieve rapid removal of paints by brief immersion followed by a few seconds of electrolysis. The aim is to avoid any attack on the metal under the paint.

Detinning by non-electrolytic solution of the tin followed by recovery of the tin from the solution so produced has also been proposed. Specifically, U.S. Pat. No. 1,511,590 (published 1924) describes a process in which tin is recovered from tinplate by (1) removing for example paint by means of a weak solution of caustic, (2) dissolving the tin by means of a hot oxidizing solution of alkali, (3) crystallizing out the resultant sodium stannate and (4) electrolyzing a solution of the redissolved sodium stannate to obtain tin metal. This is a complex multi-stage process.

SUMMARY OF THE INVENTION

The object of the invention is therefore to provide a method in which the effect of the paint on the electrolytic detinning process is reduced, or even eliminated altogether, with avoidance or reduction of the difficulties associated with the above-mentioned known methods.

The invention consists in that the painted tinplate waste is compressed, then subjected to the action of NaOH sufficient to soften the paint, and then the electrolysis treatment is carried out after the paint has been softened. It is emphasised that paint removal, prior to the electrolysis is not an essential feature of the invention, and is preferably minimized or substantially avoided. The invention achieves its effect if the paint is merely softened to allow the subsequent detinning by electrolysis. As discussed below, the same bath may be used for paint softening and electrolysis and electrolysis may be started before the paint softening is complete.

It is of course generally known that hot caustic soda softens the paint types hitherto used for tinplate within a matter of hours. The duration of this softening process depends on the paint type concerned, but generally exceeds approximately 2½hours. This means that in a prior art detinning treatment also lasting even as much as 2½hours the paint is still not softened, so that this softening can have no influence on the detinning process.

Surprisingly, however, it has been shown that electrolytic detinning is carried out much better if the paint is substantially softened by the action of caustic soda. This process does not produce ash residues, and at most only a relatively small proportion of the softened paint reaches the bath. Most of the paint remains on the detinned material. When using the resultant detinned materials as scrap for steel production, the presence of these paint residues presents no problem because they burn in the steel furnace without leaving behind any harmful constituents.

Also of importance is the step of compressing the waste tinplate. The tinplate waste is preferably compressed to a weight of 1.0 to 1.2 kg/l, although this compression is not critical, and should be determined in individual cases according to local conditions.

It is noted that in general in the past, when detinning plate, it has been sought to feed the tinplate as loosely as possible into the detinning bath in order to allow as much access as possible for the electrolyte. It presumably was always assumed that this accessibility is insufficient if the tinplate is compacted, particularly in the case of painted tinplate. Remarkably, however, it has now been shown that detinning may be carried out in a compressed mass of tinplate waste, even if this tinplate waste is painted. Detinning is not limited to the outside of the compressed mass, but takes place throughout. The softened paint generally remains on the tinplate, whilst the detinning takes place between the cast of paint and the tinplate. However, the adhesion between the paint and the tinplate is lost with the result that the coat of paint can be removed very easily. If the tinplate is compressed into a bundle, most of the paint is sealed in the bundle without, therefore, contaminating the bath. Thus prior compression of the waste provides an important advantage in combination with the softening step.

As mentioned, it has appeared that the presence of these paint residues on the tinplate scrap is not really a disadvantage when this scrap is used in a steel furnace. The paint residues are burnt off completely, and present no problem, either for the steel or for the environment. The additional heat released during combustion has hardly any effect on the process, and what effect there is only works to the advantage of the process. Nor do the paint residues contribute to corrosion and rusting on the tinplate scrap during storage and transport, but rather counteract them.

The method of the invention also does not require the use of toxic substances or additional complicated operating conditions.

It has appeared that the softening step, and the subsequent electrolysis, are not very sensitive to the form in which the compressed tinplate waste is processed. It is conceivable, for example, to press the tinplate waste into bundles which are placed on the bottom of an electrolytic bath. The current can then be fed via the bottom to the tinplate bundles forming the anode. There is also a possibility of incorporating hooks into the compressed bundles during the pressing process so that these bundles can be suspended in the bath. Many other possibilities are open to the specialist. In particular, it has appeared preferable first to press the tinplate waste into bundles, then hold it in baskets in the bath. This increases the capacity of the installation, since the placing of pressed bundles in the bath is simpler in operation than tipping the waste loose into baskets. This means, in fact that there is no necessity to use baskets which widen conically upwards, but that rectangular baskets can be used, into which the pressed bundles are carefully fed.

Another advantage of processing pressed bundles consists in that, given a constant capacity of the installation, longer treatment times can now be used both for softening and for the actual electrolytic detinning treatment.

A method of the invention is preferred in which the paint softening treatment takes place at a temperature of 70° to 90° C. preferably about 90° C., for a period of at least 8, preferably 12 to 16 hours, with a bath liquid containing 6 to 15%, preferably 10 to 11%, NaOH.

Although the detinning electrolysis may be carried out in a different bath with a liquid different from that used in the softening treatment, it has been found to be feasible and advantageous to carry out the detinning electrolysis in the same bath with the same processing liquid for the paint. This can be done even until a residual tin content of 0.02% tin or less is obtained. This detinning will in this case take longer if pressed bundles are used than if loose material is processed. The method of the invention can, for example, be implemented with a cycle time of 24 hours, e.g. 16 hours softening, including processing work, and 8 hours electrolysis. In this case the electrolysis can be carried out at night using cheap night current. Despite the much longer cycle time, however, almost the same production may be achieved with an almost identical installation.

In addition to painted tinplate, unpainted tinplate also finds its way in most cases to a detinning installation. The detinning of painted waste and unpainted waste by different processes is conceivable, but if the separation of painted from unpainted product causes problems, it is also possible by the method according to the invention to treat a mixture of painted and unpainted tinplate. Thus, current can be passed through the bath even during the softening step for the paint on the painted tinplate. Thus the unpainted product is detinned while the paint is softening on the painted tinplate waste, thereby shortening the entire process. Alternatively, the capacity of the installation can be increased as the duration of the process remains constant.

EXAMPLE

Waste from painted tinplate was first chopped to shreds to ensure that both surfaces of the tinplate (which has been processed into tins and boxes) become free. These shreds were pressed into bundles measuring 40×60×60 cm at a pressure such that the average weight of these bundles was approximately 160 kg (1.11 kg/l). These bundles were placed in steel baskets 125 cm high, with transverse dimensions of 42 and 120 cm. These baskets were filled with four bundles at a time, suspended in a bath containing 11% NaOH and at a temperature of 80° C., and connected to current conductors. At 10 cm from each basket, a steel cathode plate was suspended in the bath.

The bundles were allowed to rest in the batch for approx. 16 hours without passage of current. A voltage of 2 to 4 volts was then applied for each basket, resulting in a current of 1800A. This current flow was maintained for 8 hours. Then the bundles thus detinned were washed in water by immersion, four or more times in a water bath, as required. It was found, on examination, that the bundles thus treated had a residual tin content of less than 0.02% tin.

What is claimed is:

1. Method for the detinning of painted tinplate waste, comprising the steps of (a) compressing the painted tinplate waste into bundles which have a predetermined range of weight/volume;

(b) immersing the compressed waste bundles in a bath containing NaOH for a period of time sufficiently long that the NaOH in the bath liquid acts on the paint so as to achieve a substantial softening but not complete dislodging of the paint such that the tin under the paint can be removed subsequently by electrolysis, without completely dislodging the paint;

(c) after step (b), effecting electrolytic treatment of said bundles in a bath containing NaOH so as to remove tin from beneath the softened paint.

2. Method according to claim 1, wherein in step (a) the tinplate waste is compressed to a weight per volume in the range 1.0 to 1.2 kg/l.

3. Method according to claim 1, wherein the tinplate waste compressed into bundles arranged in baskets in the NaOH bath.

4. Method according to claim 1 wherein in step (b) the softening of the paint is carried out at a temperature of 70° to 90° C. for 12 to 16 hours, in liquid bath which has an NaOH concentration in the range 6 to 15%.

5. A method according to claim 4 wherein in step (b) the bath liquid has an NaOH concentration in the range 10 to 11%.

6. Method according to claim 1, wherein the bath in step (c) is the same as used in step (b) for softening the paint, the electrolysis being carried out until a residual tin content of 0.02% tin or less is in the treated waste obtained.

7. Method according to claim 1, in which a mixture of bundled painted and unpainted tinplate is treated, wherein current is passed through the bath during at least part of step (b).

8. In a method for the detinning of painted tinplate waste in which the waste is arranged as an anode in a bath containing NaOH and subjected to electrolytic treatment, the improvement that the tinplate waste is compressed and is then disposed into the bath, and that thereafter a period of time is allowed in which the NaOH in the bath liquid acts on the paint so as to achieve a substantial softening of the paint and that after said period of time electrolytic treatment is carried out so as to remove tin beneath the paint.

9. Method according to claim 1, wherein the electrolytic treatment is begun only after the said period of time for softening.

10. Waste tinplate treated by a method according to claim 1.

11. Method according to claim 2, wherein step (a) the tinplate waste is compressed into bundles which, in step (b) are arranged in baskets in the bath.

12. Method according to claim 6, wherein the electrolytic treatment is begun only after the said period of time for softening.

13. Method according to claim 7, wherein the electrolytic treatment is begun only after the said period of time for softening.

14. Waste tinplate treated by a method according to claim 6.

15. Waste tinplate treated by a method according to claim 7.

* * * * *